US011105061B1

(12) United States Patent
Zhou et al.

(10) Patent No.: US 11,105,061 B1
(45) Date of Patent: Aug. 31, 2021

(54) HIGH-PERFORMANCE LIQUEFACTION-RESISTANCE TREATMENT METHOD FOR GRAVEL PILE OF EXISTING BUILDING FOUNDATION

(71) Applicant: ZHEJIANG UNIVERSITY, Zhejiang (CN)

(72) Inventors: Yanguo Zhou, Zhejiang (CN); Kai Liu, Zhejiang (CN); Qiang Ma, Zhejiang (CN); Xinhui Zhou, Zhejiang (CN)

(73) Assignee: ZHEJIANG UNIVERSITY, Zhejiang (CN)

( * ) Notice: Subject to any disclaimer, the term of this patent is extended or adjusted under 35 U.S.C. 154(b) by 0 days.

(21) Appl. No.: 16/976,767

(22) PCT Filed: Aug. 20, 2019

(86) PCT No.: PCT/CN2019/101572

§ 371 (c)(1),
(2) Date: Aug. 31, 2020

(87) PCT Pub. No.: WO2021/000387

PCT Pub. Date: Jan. 7, 2021

(30) Foreign Application Priority Data

Jul. 3, 2019 (CN) ..... 201910595806.2

(51) Int. Cl.
*E02D 27/34* (2006.01)
*E02D 3/08* (2006.01)
(Continued)

(52) U.S. Cl.
CPC ..... *E02D 27/34* (2013.01); *E02D 3/08* (2013.01); *E02D 3/123* (2013.01); *E02D 31/02* (2013.01)

(58) Field of Classification Search
CPC .. E02D 3/08; E02D 3/12; E02D 3/123; E02D 27/34; E02D 31/02
See application file for complete search history.

(56) References Cited

U.S. PATENT DOCUMENTS 4,273,475 A * 6/1981 Fuller ..... E02D 27/34 405/229
5,779,397 A * 7/1998 Takemiya ..... E02D 3/12 404/31

(Continued)

FOREIGN PATENT DOCUMENTS

CN 102888834 1/2013
CN 104947651 9/2015

(Continued)

OTHER PUBLICATIONS

"International Search Report (Form PCT/ISA/210)" of PCT/CN2019/101572, dated Mar. 27, 2020, pp. 1-5.

(Continued)

*Primary Examiner* — Frederick L Lagman
(74) *Attorney, Agent, or Firm* — JCIP Global Inc.

(57) ABSTRACT

The disclosure discloses a high-performance liquefaction mitigation method forstone columns for protecting the existing buildings during earthquakes. Specifically, a small equipment is used to dig trenches in the soil around the existing building. Then, a spiral driller is used to drill a series of boreholes in the trenches according to the optimized borehole design. Next, two or three layers of optimized gravel material with high permeability are filled into the boreholes to work as the inverted layer. Finally, geotextile is arranged around the trench and the trench is filled with the optimized gravel. Compared with current liquefaction mitigation methods for existing buildings, the disclosure is suitable for liquefaction mitigation in large cities, and has the advantages of low disturbance to the overlaid building, (Continued)

simple construction process, high construction efficiency, low construction cost, long service life and the construction material could be easily obtained.

8 Claims, 4 Drawing Sheets

(51) Int. Cl.
*E02D 3/12* (2006.01)
*E02D 31/02* (2006.01)

(56) References Cited

U.S. PATENT DOCUMENTS 5,800,090 A * 9/1998 Goughnour ..... E02D 3/10 405/258.1
6,354,766 B1 * 3/2002 Fox ..... E21B 7/005 405/232
6,659,691 B1 * 12/2003 Berry ..... E02D 27/14 405/231
7,011,475 B2 * 3/2006 Shiraishi ..... E01C 3/04 405/302.4
7,290,962 B2 * 11/2007 Erdemgil ..... E02D 3/12 405/266
7,326,004 B2 * 2/2008 Wissmann ..... E02D 3/08 405/245
7,901,159 B2 * 3/2011 Fox ..... E02D 5/385 405/240
9,915,051 B2 * 3/2018 Niroumand ..... E02D 3/08
10,151,074 B2 * 12/2018 Haupt ..... E02D 5/22
2014/0010600 A1 * 1/2014 Green ..... E02D 3/08 405/302.4
2017/0058477 A1 * 3/2017 Niroumand ..... E02D 27/18
2019/0218742 A1 * 7/2019 Green ..... E04H 9/021

FOREIGN PATENT DOCUMENTS

CN 207419441 5/2018
CN 108642987 10/2018
CN 109797764 5/2019
JP 2014148884 8/2014
JP 6424504 11/2018

OTHER PUBLICATIONS

"Written Opinion of the International Searching Authority (Form PCT/ISA/237)" of PCT/CN2019/101572, dated Mar. 27, 2020, pp. 1-4.

* cited by examiner

HIGH-PERFORMANCE LIQUEFACTION-RESISTANCE TREATMENT METHOD FOR GRAVEL PILE OF EXISTING BUILDING FOUNDATION

This application is a 371 of international application of PCT application serial no. PCT/CN2019/101572, filed on Aug. 20, 2019, which claims the priority benefit of China application no. 201910595806.2, filed on Jul. 3, 2019. The entirety of each of the above mentioned patent applications is hereby incorporated by reference herein and made a part of this specification.

BACKGROUND

Technical Field

The disclosure relates to a liquefaction mitigation method for ground soil, which belongs to the field of seismic design for building, and in particular relates to a mitigation method for liquefiable soil under existing buildings.

Description of Related Art

China is located at the intersection of the world's two largest seismic belts (Circum-Pacific seismic belt and Eurasian seismic belt) and is one of the countries suffering from the most severe earthquake disasters in the world. According to statistics, ½ of the country, including 23 provincial capital cities and ⅔ of large cities with more than 1 million population, is in the zone where the scale of earthquakes can reach a high seismic magnitude of up to 7 (seismic intensity scale of China). Seismic damage surveys of global destructive earthquakes have shown that a large number of disasters are closely related to geotechnical engineering problems, and one of the serious problems is soil liquefaction.

The cause of liquefaction of saturated soil under earthquake is: when an earthquake occurs, the loose soil layer tends to become dense. Because the pores of saturated soil are filled with water, the tendency of compression of soil skeleton leads to the increase of pore water pressure for the water could not dissipate in a short time during shaking. When the pore water pressure arises, the effective stress between the soil particles will drop. When the effective stress between the soil particles drops to zero, the soil particles will be completely suspended in the water and exhibits like the fluid. At this moment, the soil completely loses its strength and bearing capacity. The above process is called soil liquefaction. When the seismic load disappears, the pore water pressure will gradually dissipate under the pore water pressure gradient, and the soil will gradually restore its original strength. The increase of pore water pressure of liquefiable soil under the earthquake is inevitable. By increasing the drainage performance of liquefiable foundation, it is possible to quickly dissipate the generated pore water pressure, such that the soil could quickly restore the original stiffness and strength, which is an effective approach to reduce the damage caused by soil liquefaction, and stone column technique is an application of such an approach.

The stone column is firstly to form the borehole in the liquefiable ground soil by means of vibration, punching, water flushing, etc., and then squeeze gravel into the formed borehole, thereby forming a dense gravel column. The column works with surrounding soil to form a composite foundation. With the gravel column material, the ground soil has a larger permeability, so that the excess pore pressure generated in the soil can be dissipated quickly. However, based on the current guidelines of design methods, such as "Technical code for ground treatment of buildings. JGJ79-2012" of China, the technical code for gravel column design method simply focuses on the densification improved by stone columns to increase the liquefaction resistance of ground soil to the requirement without consideration on the drainage effect, which could dissipate excess pore pressure as quickly as possible. Accordingly, the vertical gravel column is widely adopted in situ condition rather than an inclined one. Furthermore, among the regulations adopted in China, America and Japan, the design methods for stone columns only apply to free-field condition, and there is no design method of stone columns for existing buildings. In light of the above, proposing a stone column design method for existing buildings condition, in particular in large cities, is important for earthquake-proof building design to be achieved by one of the national strategy of "establishing resilient cites".

SUMMARY

Technical Problem

In order to solve the problems in the background, the disclosure discloses a high-performance stone column design method for ground soil under existing buildings. The disclosure mainly considers the fast drainage effect of the liquefaction-mitigation mechanism for stone columns, which can solve the technical problem encountered in the background.

The technical solution adopted by the disclosure is as follows.

First, trenches are arranged around the foundation of the existing buildings, and then boreholes are designed in the trenches. The bottom of the boreholes could reach the liquefiable soil, and the gravel material with optimized design is filled into the boreholes and the trenches following the predetermined construction design, thereby forming a stone column improved composite foundation with good hydraulic permeability, so as to realize liquefaction mitigation for existing buildings.

Multiple boreholes could be arranged in the trench, and the multiple boreholes are evenly distributed along the trench.

A vertical water drainage channel with good water permeability can be established by filling the trench with gravel material to form the gravel bedding. Accordingly, the water in the liquefiable soil is allowed to dissipate into the gravel bedding. In this way, the gravel bedding could support the overlaid buildings and foundations and protect them from liquefaction during shaking.

The gravel material is crushed stones.

The excavation depth of the trench needs to exceed the depth of the foundation of the existing buildings.

The trenches are elongated ditches arranged around the foundation of the existing building to be protected, but not arranged around the foundations of other existing buildings adjacent to the existing building to be protected. The design for trenches should consider the surrounding buildings, the underground pipelines of existing building to be protected and etc.

The boreholes are installed in the trenches in the following manner: the diameter of the boreholes are selectively 50 to 80 cm; the spacing of the borehole is smaller than 4.5 times the diameter of the column; the boreholes could be designed to pass through the liquefiable soil but not to exceed 15 m.

The borehole could be designed as vertical one that is perpendicular to the ground surface, or the inclined one that is not perpendicular to the ground surface and inclined toward the existing building to be protected along the depth, or a combination of the vertical and inclined ones.

The included angle between the axial direction of the inclined boreholes and the ground surface is larger than 60 degrees.

Specifically, the installation details of boreholes and trenches are as follows. First, the first borehole is formed in the trench by using a driller with a thicker drilling pipe based on the predetermined design diameter and depth. Then the first filler with optimized designed grain distribution is filled into the first borehole layer by layer, accompanied by compaction layer by layer until the borehole is completely filled with the filler. Thereafter, a second borehole is formed in the first filler in the first borehole by using the driller with a thinner drilling pipe, then the second filler with optimized grain distribution is filled into the second borehole. Next, a third borehole is formed in the second filler in the second borehole by using the driller with a drilling pipe that its diameter is smaller than that of the second borehole, then the third filler with optimized grain distribution is filled into the third borehole. The first filler, the second filler and the third filler are all adopted as gravel. The average grain diameters of the first filler, the second filler and the third filler are increased in sequence. The trench is fully filled with the third filler.

The grain distribution of the gravel of the first filler, the second filler and the third filler are determined based on the following formula.

1) The formula for design of the first filler is as follows.

$$\begin{cases} C_{u1} = \dfrac{D_{60}}{D_{10}} < 1.5 \\ k_1 = 2D_{10}^2 e^2 > 100k_0 \\ \dfrac{D_{15}}{d_{85}} \le 4-5 \\ \dfrac{D_{15}}{d_{15}} \ge 5 \end{cases}$$

Where: $C_{u1}$ represents the non-uniformity coefficient of the first filler in the external layer; $k_0$ and $k_1$ represent the permeability coefficients of the ground soil and the first filler; respectively; $d_{10}$, $d_{15}$, $d_{60}$ and $d_{85}$ represent the particle diameters of the ground soil accounting for 10%, 15%, 60% and 85% of the total weight of the ground soil respectively; $D_{10}$ and $D_{15}$ represent the particle diameters of the gravel material of the first filler accounting for 10% and 15% of the total weight of the gravel material of the first filler.

2) The formula for design of the second filler is as follows.

$$\begin{cases} C_{u2} = \dfrac{Z_{60}}{Z_{10}} < 1.5 \\ k_2 = 2Z_{10}^2 e^2 > k_1 \\ \dfrac{Z_{15}}{D_{85}} \le 4-5 \\ \dfrac{Z_{15}}{D_{15}} \ge 5 \end{cases}$$

Where: $C_{u2}$ represents the non-uniformity coefficient of the gravel material of the second filler; $k_2$ represents the permeability coefficient of the gravel material of the second filler; $Z_{10}$ and $Z_{15}$ represent the particle diameters of the gravel material of the second filler in the intermediate layer accounting for 10% and 15% of the total weight of the gravel material of the second filler.

3) The formula for design of the third filler is as follows.

$$\begin{cases} C_{u3} = \dfrac{Y_{60}}{Y_{10}} < 1.5 \\ k_3 = 2Y_{10}^2 e^2 > k_2 \\ \dfrac{Y_{15}}{Z_{85}} \le 4-5 \\ \dfrac{Y_{15}}{Z_{15}} \ge 5 \end{cases}$$

Where: $C_{u3}$ represents the non-uniformity of the gravel material; $k_3$ represents the permeability coefficient of the third layer of gravel material; $Y_{10}$ and $Y_{15}$ represent the particle diameters of the gravel material of the third filler in the internal layer accounting for 10% and 15% of the total weight of the gravel material of the third filler.

In order to make the three layer of fillers to effectively prevent the ground soil from infiltrating into the fillers, the first filler adopts the liquefiable ground soil as the protected material to determine the grain gradation; the second filler adopts the first filler as the protected material to determine the grain gradation; the third filler adopts the second filler as the protected material to determine the grain gradation and so forth. In the disclosure, three layers of filler in actual construction could ensure the stone columns working as vertical dissipation channel not to be clogged.

Geotextile is arranged at the bottom and lateral sides of the trenches, then the gravel material that is the same with the third filler is filled in the trenches.

Specifically, a small equipment is used to dig the trenches in the ground soil around the existing building. Then, a spiral driller is used to drill a series of boreholes in the trench according to the optimized borehole design. Next, the optimized gravel material of the first filler is filled into the boreholes to form the first filler. And then the borehole was formed with driller in the first filler and then filled with the gravel material of the second filler, such that the two kinds of gravel materials constitute an inverted layer. Then the geotextile is arranged around the trench and the trench is fully filled with the graded gravel.

The advantageous effects of the disclosure are described as follows.

1) The design the disclosure initiates a stone column design method for liquefaction mitigation for existing buildings, thus providing a new concept and solution for improvement of ground soil under existing buildings in large cities.

2) The design of the disclosure initiates an inclined borehole which can be formed in an inclined manner right below the existing building, thereby accelerating the dissipation of the excess pore water pressure right below the existing building during earthquakes.

3) The design of the disclosure initiates a stone column construction method by performing multiple drillings and fillers, which could not only accelerate water drainage but also prevent clogging of stone column, and therefore its service life is longer.

4) The design for the gravel materials in the disclosure are based on principles of soil mechanics; the graded gravel is easily obtained with low cost.

5) The design of the method in the disclosure adopts small machineries or human labor for on-site construction. Therefore, the required construction space is small, and there is not much noise caused by construction. The disturbance caused by the construction to the upper building and the foundation thereof is small, and therefore the method is suitable for being performed in cities with many buildings.

Compared with current liquefaction mitigation methods for existing buildings, the disclosure has the advantages of low disturbance to the foundation and upper building, simple construction process, broad applicability, high construction efficiency, long service life, low construction cost and the construction material could be easily obtained.

In the figures: 1. existing building to be protected; 2. foundation of existing building; 3. trench; 4. inclined borehole; 5. vertical borehole; 6. liquefiable foundation soil; 7. first filler; 8. second filler; 9. third filler.

DESCRIPTION OF THE EMBODIMENTS

In the following, further description will be made in conjunction with the drawings and embodiments. The following examples are only used to illustrate the disclosure and not to limit the scope of the disclosure. In addition, it should be understood that, after reading the contents of the disclosure, those skilled in the art can make various changes or modifications to the disclosure, and these equivalents also fall within the scope defined by the appended claims of the present application.

Figure 1:
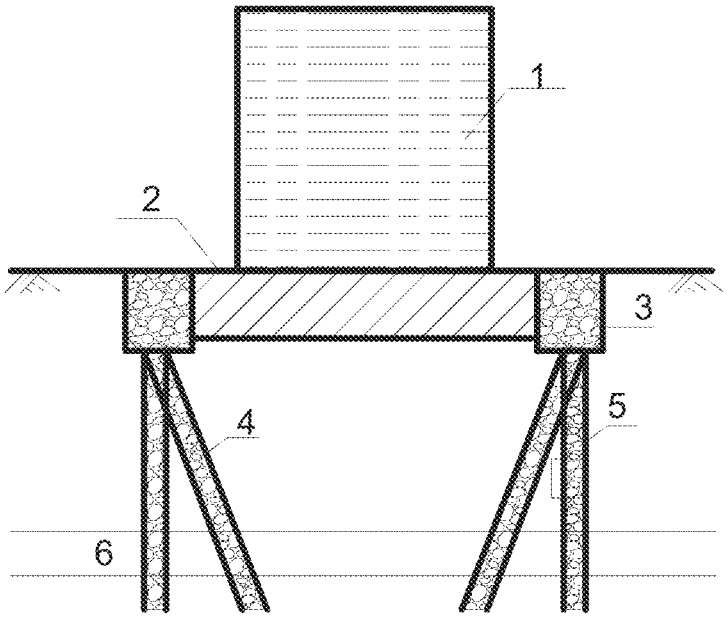
FIG. 1 is a sectional view of the combination of vertical borehole and inclined borehole.
Figure 2:
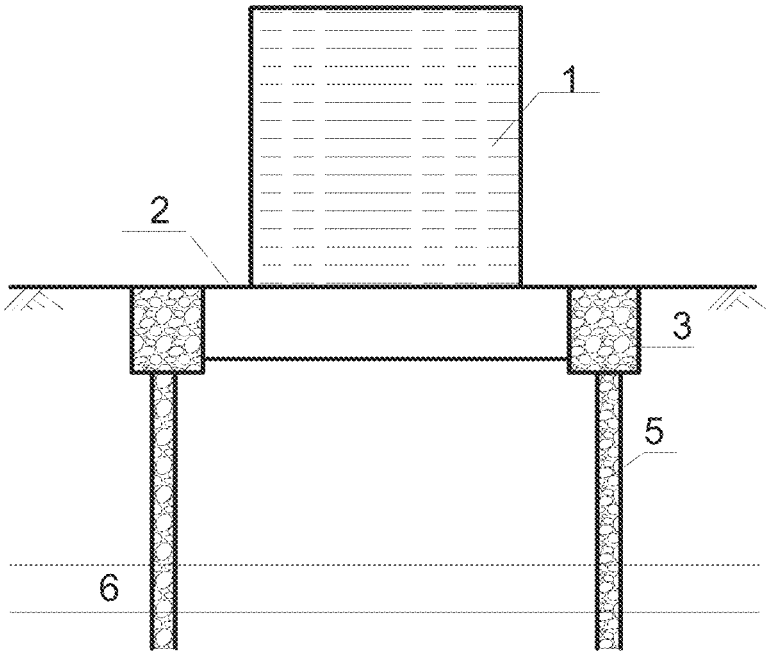
FIG. 2 is a cross-sectional view of a typical vertical borehole.
Figure 3:
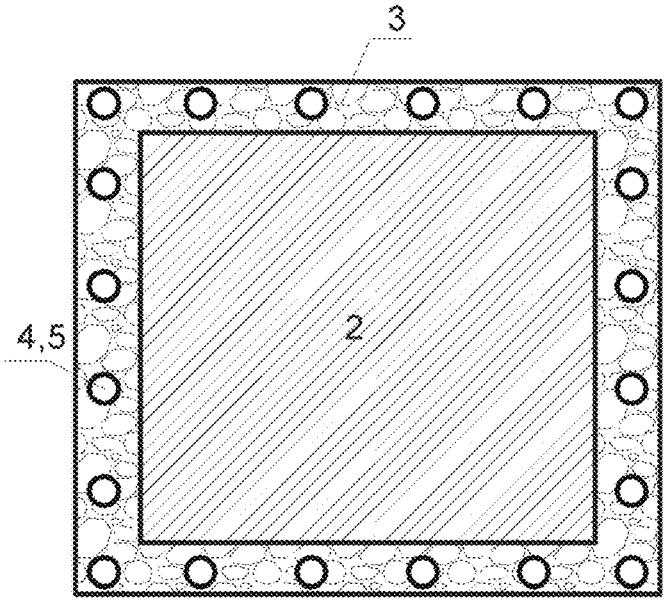
FIG. 3 is a top view of the design.

In the specific implementation, as shown in FIG. 1 and FIG. 2, according to the survey data of the existing buildings, firstly the trench 3 is arranged around the foundation 2 of the existing building, and the trench 3 closely surrounds the foundation 2, as shown in FIG. 3. Then, a borehole 4/5 is arranged in the trench 3, and the bottom end of the borehole 4/5 extends below the liquefiable soil 6, and the optimized gravel material is filled into the boreholes 4/5 and the trench 3 following the designed construction process to form the composite foundation with good hydraulic permeability, so as to realize the liquefaction mitigation for the existing building 1.

The design parameters of width of the trench 3 need to be compatible with the in-situ construction space and construction equipment. Due to the small construction space around the existing building, only small construction machinery and equipment such as small excavators can be selected. Preferably, the trench width is designed to be 50 to 100 cm. In the specific implementation, the depth of the trench 3 exceeds the depth of the foundation 2 of the existing building 1, and preferably, the exceeding depth is 30 to 50 cm.

The trench 3 is an elongated ditch, and the trench 3 is arranged around the foundation 2 of the existing building 1 to be protected, but not arranged around the foundation of other existing building adjacent to the existing building 1.

Figure 4:
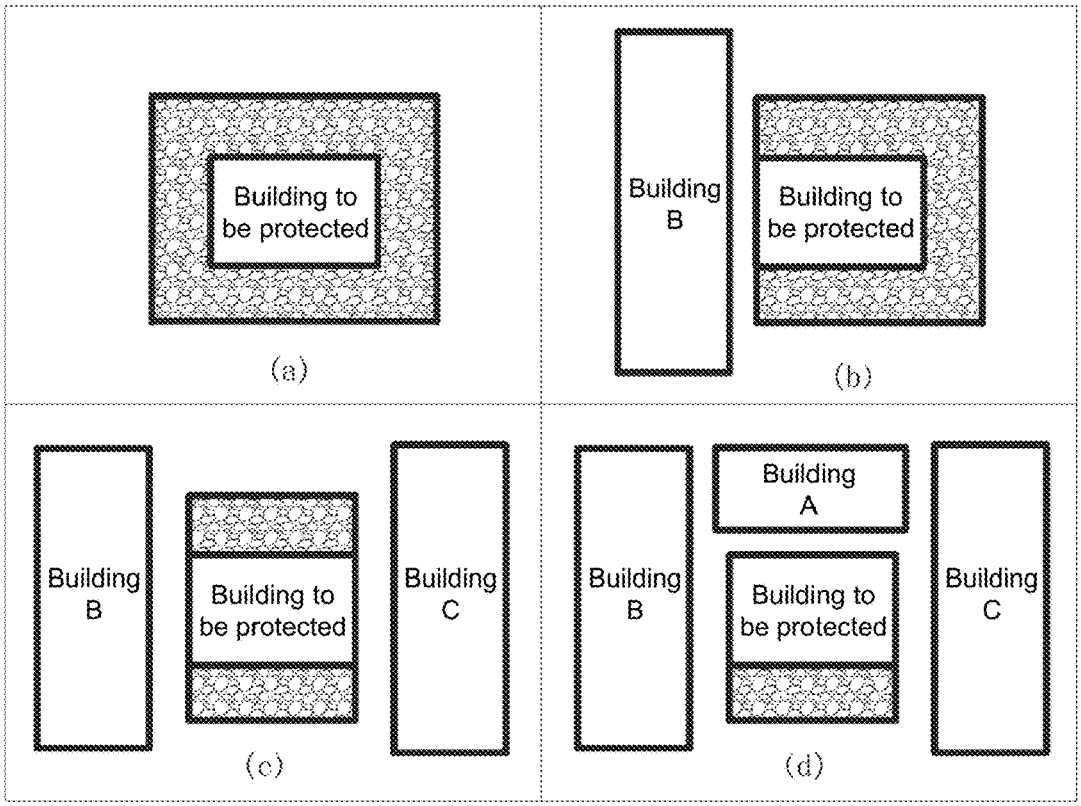
FIG. 4 is a schematic view of arrangement of trenches for different types of construction sites: (a) surrounding trench; (b) trilateral trench; (c) bilateral trench; (d) unilateral trench.

As shown in FIG. 4, the trenches 3 are arranged around the existing building depending on actual circumstances of surrounding buildings. The main principle is to accelerate the dissipation of excess pore water pressure during an earthquake. The trench 3 can be designed into four types, including surrounding trench, trilateral trench, bilateral trench or unilateral trench as shown in FIG. 4.

The borehole 4/5 is arranged in the trench 3. The diameter of borehole 4/5 is generally 30 to 80 cm according to the stone column construction regulations. In consideration of the special filling method in the disclosure, the diameter of borehole 4/5 is 50 to 80 cm. The spacing between the boreholes 4/5 is calculated based on the water discharge of the foundation 2, and is not larger than 4.5 times the diameter of the borehole. The borehole 4/5 passes through the liquefiable soil 6, but the depth of the borehole 4/5 is not larger than 15 m.

As shown in FIG. 1 and FIG. 2, the borehole 4/5 is a vertical borehole 5 with its axial direction being perpendicular to the ground surface, or an inclined borehole 4 that its axial direction is not perpendicular to the ground surface, and it inclines toward the existing building 1 to be protected along the depth, or a combination of the vertical borehole 5 and the inclined borehole 4.

The included angle between the axial direction of the inclined borehole 4 and the level ground is larger than 60 degrees, and preferably 75 degrees.

Figure 5:
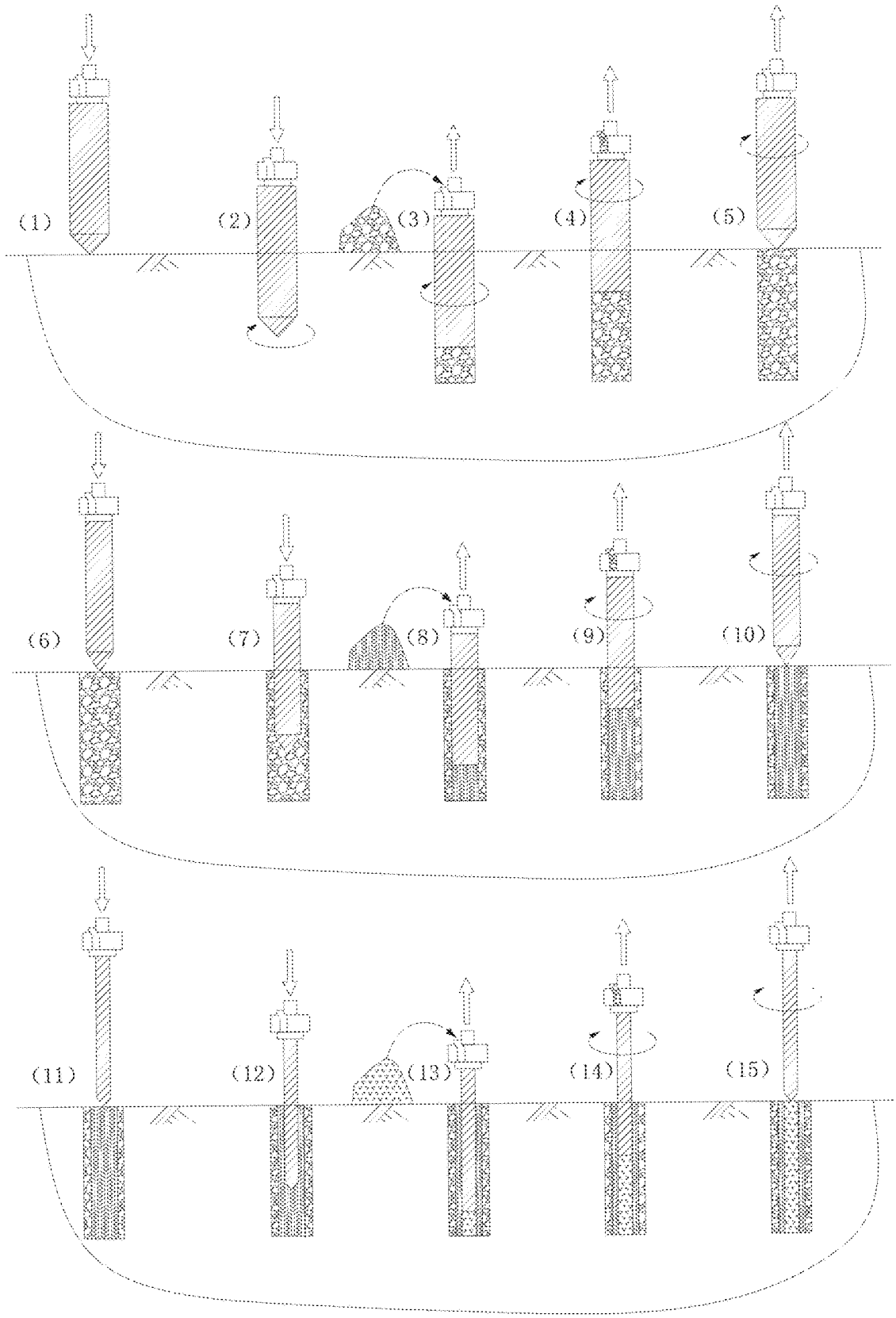
FIG. 5 is a process flow of a construction method with three times of drilling and filler.

As shown in FIG. 5, the construction and filling of borehole 4/5 and the trench 3 are carried out with multiple times of drilling and filling. The three times of drilling and filling are specifically as described below.

1) First, the first borehole is formed in the trench 3 by using a driller with a thicker drilling pipe based on the predetermined design diameter and depth. Then the first filler with optimized designed grain distribution is filled into the first borehole layer by layer, accompanied by compaction layer by layer until the borehole is completely filled with the filler.

2) Thereafter, a second borehole is formed in the first filler in the first borehole by using the driller with a thinner drilling pipe, and then the second filler with optimized grain distribution is filled into the second borehole.

3) Thereafter, a third borehole is formed in the second filler in the second borehole by using the driller with a drilling pipe that its diameter is smaller than that of the second borehole, and then the third filler with optimized grain distribution is filled into the third borehole.

Figure 6:
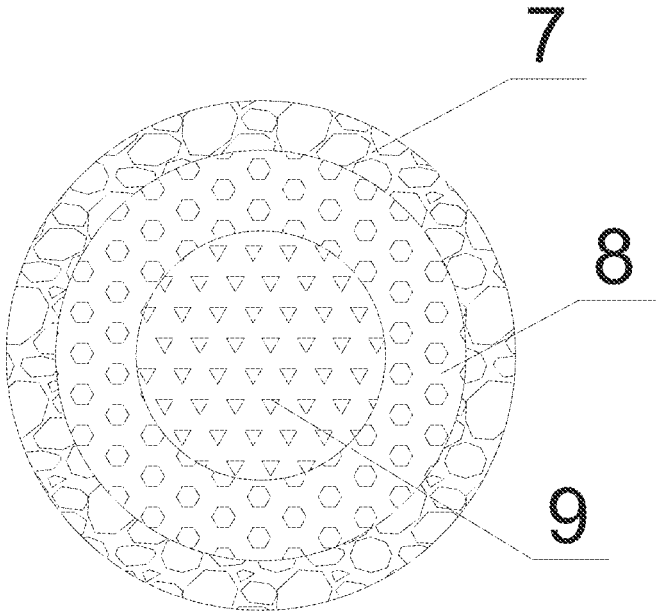
FIG. 6 is a top view showing drilling in the construction method with three times of drilling and filler.

In the above process, the first filler, the second filler and the third filler are all adopted as gravel. As shown in FIG. 6, the average grain diameters of the first filler, the second filler and the third filler are increased in sequence, such that the particle diameters of the gravel from internal layer to the external layer are decreased in sequence, and finally a three-layer stone column with internal, intermediate and external layers is formed. The formed stone column is in a shape of concentric cylinder and circular column shape. Moreover, the trench 3 is fully filled with the third filler.

The first to the third layers are filled layer by layer. Specifically, the fillers adopt graded gravel material, which is optimized designed and not only has high permeability but also acts as an inverted layer to prevent the soil from entering the gravel body along with the excess pore water.

Furthermore, the grain distribution of the gravel of the first filler, the second filler and the third filler are determined based on the following formula.

1) The formula for design of the first filler is as follows.

$$\begin{cases} C_{u1} = \frac{D_{60}}{D_{10}} < 1.5 \\ k_1 = 2D_{10}^2 e^2 > 100k_0 \\ \frac{D_{15}}{d_{85}} \leq 4-5 \\ \frac{D_{15}}{d_{15}} \geq 5 \end{cases}$$

Where: $C_{u1}$ represents the non-uniformity coefficient of the first filler in the external layer; $k_0$ and $k_1$ represent the permeability coefficients of the ground soil and the first filler; respectively; $d_{10}$, $d_{15}$, $d_{60}$ and $d_{85}$ represent the particle diameters of the ground soil accounting for 10%, 15%, 60% and 85% of the total weight of the ground soil respectively; $D_{10}$ and $D_{15}$ represent the particle diameters of the gravel material of the first filler accounting for 10% and 15% of the total weight of the gravel material of the first filler.

2) The formula for design of the second filler is as follows.

$$\begin{cases} C_{u2} = \frac{Z_{60}}{Z_{10}} < 1.5 \\ k_2 = 2Z_{10}^2 e^2 > k_1 \\ \frac{Z_{15}}{D_{85}} \leq 4-5 \\ \frac{Z_{15}}{D_{15}} \geq 5 \end{cases}$$

Where: $C_{u2}$ represents the non-uniformity coefficient of the gravel material of the second filler; $k_2$ represents the permeability coefficient of the gravel material of the second filler; $Z_{10}$ and $Z_{15}$ represent the particle diameters of the gravel material of the second filler in the intermediate layer accounting for 10% and 15% of the total weight of the gravel material of the second filler.

3) The formula for design of the third filler is as follows.

$$\begin{cases} C_{u3} = \frac{Y_{60}}{Y_{10}} < 1.5 \\ k_3 = 2Y_{10}^2 e^2 > k_2 \\ \frac{Y_{15}}{Z_{85}} \leq 4-5 \\ \frac{Y_{15}}{Z_{15}} \geq 5 \end{cases}$$

Where: $C_{u3}$ represents the non-uniformity of the gravel material; $k_3$ represents the permeability coefficient of the third layer of gravel material; $Y_{10}$ and $Y_{15}$ represent the particle diameters of the gravel material of the [first]third filler in the internal layer accounting for 10% and 15% of the total weight of the gravel material of the third filler.

In this way, the third filler with large particle diameter and the first filler with small particle diameter are formed inside the borehole, which could act as an inverted layer that blocks the external soil particle going into the borehole but only the excess pore water.

Geotextiles are arranged at the bottom and lateral sides of the trench 3, and then the gravel material of the third filler is put in the trenches. The geotextiles prevent the ground soil particles from blocking the drainage channel of the gravel material in the trenches.

Further, the graded gravel is filled in the trench in a manner of layer by layer. Preferably, the thickness of each layer is limited within 20 cm, and each layer should be hard-pressed after filling until the filler reaches the same level as the foundation of the protected building.

Moreover, in specific implementation, the stone column and water drainage calculations are according to the following steps.

1) Determine the maximum residual volume strain $(\varepsilon_{vr})_{max}$ according to the standard penetration base N and the level of seismic shear stress that a site may be subjected to, and use the following formula to multiply the maximum residual body strain by the vertical settlement correction coefficient $C_s$ to obtain the residual settlement $\varepsilon_{vr}$:

$$\varepsilon_{vr}=C_s\times(\varepsilon_{vr})_{max}$$

In the specific implementation, the value of vertical settlement correction coefficient $C_s$ is 0.84.

2) Use the following formula to obtain the volume change V1 of the liquefiable soil 6 (liquefiable layer) under the seismic loading:

$$V1=L1\times L2\times T\times\varepsilon_{vr}$$

Specifically, L1 and L2 represent the length and width of the existing building to be protected, and T represents the thickness of the liquefiable soil 6 right under the existing building to be protected.

3) Use the following formula to obtain the water discharge q2 of the stone column per unit time:

$$V2=n1\times V1$$

$$q2=V2/t$$

Specifically, t represents the time required for dissipating the excess pore pressure generated by the earthquake; n1 represents the parameter determined according to the layout of the trench and ranges from 4 to 9 in specific implementation; V2 represents the total water discharge of the stone columns.

The parameter n1 is determined according to the arrangement of the trench around the existing building. The trench can be classified into four types, namely, surrounding trench, trilateral trench, bilateral trench and unilateral trench, wherein the total water discharge V2 through the stone columns is 9 times, 6 times, 6 times and 4 times V1 for the four types respectively, and thus the corresponding n1 for the four types of trenches is 9, 6, 6 and 4 respectively.

4) It is assumed that the liquefiable sand layer liquefies during earthquake. The vertical hydraulic gradient i of the gravel pile is calculated using the following formula:

$$i = \frac{\gamma}{\gamma_w} - 1$$

Specifically, H represents the buried depth of the liquefiable soil 6, $\gamma$ represents the average effective gravity of the overlaid soil layer, and $\gamma_w$ represents the unit weight of water, which generally equals to 10 kN/m$^3$.

5) All the excess pore water generated during earthquake is discharged from the interface between the stone column and the liquefiable soil 6. The interface area S is the side area of the cylinder. The permeability coefficient k of the gravel pile is calculated according to the following formula:

$$S=2\pi rT$$

k>=q2/S/n2/i

Specifically, r is the radius of the stone column, n2 is the number of the stone columns, and S is the interface area between the stone column and the liquefiable soil 6.

6) The diameter of the borehole is set to 50 to 80 cm. According to the above formula, the borehole diameter parameter is taken into the formula and the maximum integer is taken to obtain the number of boreholes. For example, if the calculation result is 14.2, the number of boreholes should be 15.

In this manner, the permeability coefficient of the gravel material, the diameter of the borehole and the number of boreholes could be determined for later construction.

During the design process, the most important parameters are the diameter, spacing and depth of the borehole. Currently, the in-situ diameter of stone column is generally ranging from 30 to 80 cm. Considering that the construction method in the disclosure, which requires the multiple drilling and filling, the currently adopted diameter of stone column is increased by 20 cm, preferably 50 to 80 cm. The borehole spacing is calculated based on the subsequently obtained water drainage amount of the liquefiable soil, and is not greater than 4.5 times of the pile diameter. The bottom of the borehole should be deeper than the depth of the liquefiable layer, so that the excess pore pressure accumulated in the liquefiable layer under earthquake can be quickly dissipated through the stone columns, and the depth for stone column is not greater than 15 m.

The specific embodiment and implementation process of the disclosure are as follows.

Assuming that the seismic fortification level where the existing building locates is 0.25 g, the standard penetration blow counts of the liquefiable soil layer under the existing building is N=10, and it can be obtained from FIG. 1 that the maximum residual volume strain $(\varepsilon_{vr})_{max}$=4%.

In this manner, the residual settlement $\varepsilon_{vr}$ can be obtained, and the value of $C_s$ is 0.84.

$$\varepsilon_{vr}=C_s\times(\varepsilon_{vr})_{max}=0.84*4\%=0.336\%$$

Assuming that the thickness of the liquefiable foundation is 1 m, and the length and width of the existing building are shown in FIG. 3 and both are set to be 4 m, then it can be obtained that the volume change V1 of the liquefiable layer under seismic loading is:

$$V1=L1\times L2\times T\times\varepsilon_{vr}=4\times4\times1\times0.336\%=0.05376\ \mathrm{m}^3$$

Assuming that the layout of the trench around the existing building is surrounding trench type, and n1=9, then the total water discharge V2 through the stone column can be determined. Assuming that the excess pore pressure generated by the earthquake needs to be dissipated within 30 minutes, and the water discharge through the stone column in unit time is q2, then it can be calculated and obtained that:

$$V2=n1\times V1=0.48384\ \mathrm{m}^3$$

$$q2=V2/t=0.48384/18=0.02688\ \mathrm{m}^3/\mathrm{s}$$

Assuming that the liquefiable sand layer liquefies during earthquake, the average effective unit weight of the overlying soil layer is $\gamma$=20 kN/m$^3$, and the unit weight of water is 10 kN/m$^3$, then according to Darcy's law, the vertical hydraulic gradient i of the gravel pile can be obtained as:

$$i=\frac{\gamma}{\gamma_w}-1=\frac{20}{10}-1=1$$

All the excess pore water generated during the earthquake is discharged from the interface between the stone column and the liquefiable sand layer. The interface is the side area of the cylinder, assuming that the radius of the gravel pile is r, then the area S is calculated as follows:

$$S=2\pi rT=2*3.14*r*1=6.28r$$

Assuming that there are n2 stone columns in total, the permeability coefficient k of the stone column is calculated as follows:

$$k*r*n2>=4.28e-3$$

Generally speaking, the permeability coefficient of the liquefiable sand layer ranges from 1 e-5 m/s to 1e-6 m/s, the permeability coefficient herein is set to be 5e-6 m/s, then the permeability coefficient of the gravel material is assumed to be 200 times the ground soil, then k=0.001 m/s, so it can be obtained that:

$$r*n2=4.28$$

In the specific implementation, the radius of the gravel pile is set to be 0.6 m, then it can be obtained that:

$$n2>=4.28/0.6=7.13$$

8 stone columns are taken herein as the calculation result.

That is to say, for the site conditions described in this embodiment, the surrounding trench is arranged, two stone columns are set in the trench on each side, and the spacing is 2 m.

For gravel materials, the porosity ratio e is generally between 0.4 to 0.6, where 0.5 is taken, the calculation is performed according to the following formula:

$$k=2D_{10}^2e^2$$

In the calculation result, it is obtained that D10=0.447 for the first filler, and other parameters such as $D_{60}$ and $C_u$ for the first filler are calculated and obtained according to the above corresponding formula. And the parameters for the second and third filler could also be determined based on the above formula.

What is claimed is:

1. A high-performance liquefaction mitigation method for a stone column for an existing building, comprising:

firstly, a trench being arranged around a foundation of an existing building; then, a borehole being arranged in the trench, and a bottom end of the borehole extending below a liquefiable soil; and an optimized gravel filler being filled into the borehole and the trench in accordance with a specified construction method to form a stone columns improved composite foundation with good water dissipate ability, so as to protect the existing building;

installation details of the borehole and the trench being as follows:

first, a first borehole is formed in the trench by using a driller with a thicker drilling pipe based on a predetermined design diameter and depth; then, a first filler is filled into the first borehole layer by layer, accompanied by compaction layer by layer until the borehole is completely filled with the filler;

thereafter, a second borehole is formed in the first filler in the first borehole by using the driller with a thinner drilling pipe; then, a second filler is filled into the second borehole;

next, a third borehole is formed in the second filler in the second borehole by using the driller with a drilling pipe that its diameter is smaller than that of the second borehole; then, a third filler is filled into the third borehole;

the first filler, the second filler and the third filler are all adopted as gravel, average grain diameters of the first filler, the second filler and the third filler are increased in sequence; a three-layer stone column with internal, intermediate and external layers is formed; and the trench is fully filled with the third filler.

2. The high-performance liquefaction mitigation method for stone column for the existing building according to claim 1, wherein the depth of the trench is deeper than that of the foundation of the existing building.

3. The high-performance liquefaction mitigation method for stone column for the existing building according to claim 1, wherein the trench is an elongated ditch arranged around the foundation of the existing building to be protected, but not arranged around the foundation of other existing buildings adjacent to the existing building to be protected.

4. The high-performance liquefaction mitigation method for stone column for the existing building according to claim 3, wherein the borehole arrangement is a vertical borehole perpendicular to the ground surface; an inclined borehole that is not perpendicular to the ground surface, and it inclined toward the existing building to be protected along the depth; or a combination of the vertical borehole and the inclined borehole.

5. The high-performance liquefaction mitigation method for stone column for the existing building according to claim 4, wherein an included angle between an axial direction of the inclined borehole and a ground surface is larger than 60 degrees.

6. The high-performance liquefaction mitigation method for stone column for the existing building according to claim 1, wherein the borehole is arranged in the trench, a diameter of the borehole is selectively 50 to 80 cm and a spacing of the borehole is not larger than 4.5 times a diameter of a pile in the borehole; and the borehole passes through the liquefiable foundation soil but its length is not larger than 15 m.

7. The high-performance liquefaction mitigation method for stone column for the existing building according to claim 1, wherein grain distributions of gravel material of the first filler, the second filler and the third filler are determined based on the following formula:

1) a formula for design of the first filler is as follows:

$$\begin{cases} C_{u1} = \dfrac{D_{60}}{D_{10}} < 1.5 \\ k_1 = 2D_{10}^2 e^2 > 100k_0 \\ \dfrac{D_{15}}{d_{85}} \le 4-5 \\ \dfrac{D_{15}}{d_{15}} \ge 5 \end{cases}$$

where: $C_{u1}$ represents the non-uniformity coefficient of the first filler in an external layer; $k_0$ and $k_1$ represent the permeability coefficients of the ground soil and the first filler in the external layer; respectively; $d_{10}$, $d_{15}$, $d_{60}$ and $d_{85}$ represent the particle diameters of the ground soil accounting for 10%, 15%, 60% and 85% of the total weight of the ground soil respectively; $D_{10}$ and $D_{15}$ represent the particle diameters of the gravel material of the first filler in the external layer-accounting for 10% and 15% of the total weight of the gravel material of the first filler;

2) a formula for design of the second filler is as follows:

$$\begin{cases} C_{u2} = \dfrac{Z_{60}}{Z_{10}} < 1.5 \\ k_2 = 2Z_{10}^2 e^2 > k_1 \\ \dfrac{Z_{15}}{D_{85}} \le 4-5 \\ \dfrac{Z_{15}}{D_{15}} \ge 5 \end{cases}$$

where: $C_{u2}$ represents the non-uniformity coefficient of the gravel material of the second filler; $k_2$ represents the permeability coefficient of the gravel material of the second filler; $Z_{10}$ and $Z_{15}$ represent the particle diameters of the gravel material of the second filler in an intermediate layer accounting for 10% and 15% of the total weight of the gravel material of the second filler;

3) a formula for design of the third filler is as follows:

$$\begin{cases} C_{u3} = \dfrac{Y_{60}}{Y_{10}} < 1.5 \\ k_3 = 2Y_{10}^2 e^2 > k_2 \\ \dfrac{Y_{15}}{Z_{85}} \le 4-5 \\ \dfrac{Y_{15}}{Z_{15}} \ge 5 \end{cases}$$

where: $C_{u3}$ represents the non-uniformity of the gravel material; $k_3$ represents the permeability coefficient of the third layer of gravel material; $Y_{10}$ and $Y_{15}$ represent the particle diameters of the gravel material of the third filler in an internal layer accounting for 10% and 15% of the total weight of the gravel material of the third filler.

8. The high-performance liquefaction mitigation method for stone column for the existing building according to claim 1, wherein a geotextile is arranged at a bottom and lateral sides of the trench, then a gravel material of the first, the second and the third fillers is arranged thereon.

* * * * *